US010618756B2

(12) United States Patent
Haug

(10) Patent No.: US 10,618,756 B2
(45) Date of Patent: Apr. 14, 2020

(54) APPARATUS FOR SEPARATING ITEMS OF MAIL FED TO A FRANKING MACHINE ON A PROCESSING LINE, SUCH AS ENVELOPES, MAILERS, CARDS, PRINTED PRODUCTS, SLEEVES, LABELS

(71) Applicant: FRAMA AG, Lauperswil (CH)

(72) Inventor: Thomas Peter Haug, Bern (CH)

(73) Assignee: FRAMA AG, Lauperswil (CH)

( * ) Notice: Subject to any disclaimer, the term of this patent is extended or adjusted under 35 U.S.C. 154(b) by 0 days.

(21) Appl. No.: 16/058,438

(22) Filed: Aug. 8, 2018

(65) Prior Publication Data

US 2019/0152728 A1 May 23, 2019

(30) Foreign Application Priority Data

Nov. 22, 2017 (EP) ..... 17405030

(51) Int. Cl.
*B65H 3/06* (2006.01)
*B65H 3/56* (2006.01)
*B65H 3/52* (2006.01)

(52) U.S. Cl.
CPC ..... *B65H 3/063* (2013.01); *B65H 3/5238* (2013.01); *B65H 3/56* (2013.01); *B65H 2701/1916* (2013.01)

(58) Field of Classification Search
CPC ..... B65H 7/02; B65H 2553/612; B65H 1/06; B65H 3/063; B65H 3/5276; B65H 3/5284; B65H 3/5292; B65H 3/5238; B65H 3/523; B65H 3/56; B65H 3/565
See application file for complete search history.

(56) References Cited

U.S. PATENT DOCUMENTS 4,573,673 A 3/1986 Haug
5,393,045 A * 2/1995 Fujimoto ..... B65H 1/06 271/111
5,707,057 A 1/1998 Oyama
6,575,453 B2 * 6/2003 Chiang ..... B65H 3/063 271/124

(Continued)

FOREIGN PATENT DOCUMENTS

CH 650995 A5 8/1985
EP 1882536 A1 1/2008

*Primary Examiner* — Jeremy R Severson
(74) *Attorney, Agent, or Firm* — Lucas & Mercanti, LLP; Klaus P. Stoffel

(57) ABSTRACT

An apparatus for separating for franking/printing flat items of mail, which are supplied individually in a feeder or are guided at a front edge lying on one another as a stack and are each gripped at the underside of the stack by a separating device, separated and transported onward in a conveying direction, wherein the separating device is formed to pick up and transport the respectively lowest item of mail at the front end in the conveying direction for onward transport, and includes driven conveying drums, mounted transversely with respect to the conveying direction and arranged one after another underneath the to stack and forming a conveying plane, and forming a passage opening with the lower end of a positioning wall of the feeder and the conveying plane, and a sweeping device acting in a sweeping manner at least on the lowest item of mailafter the passage opening.

11 Claims, 4 Drawing Sheets

(56) References Cited

U.S. PATENT DOCUMENTS

| | | | | |
|---|---|---|---|---|
| 7,694,955 | B2 * | 4/2010 | Asada | B65H 3/0684 271/121 |
| 7,815,185 | B2 * | 10/2010 | Claris | B65H 3/063 271/121 |
| 7,988,144 | B2 * | 8/2011 | Coret | B65H 3/063 271/121 |
| 8,517,166 | B2 * | 8/2013 | Jost | B65H 3/063 198/624 |
| 9,745,159 | B2 * | 8/2017 | Fulleringer | B65H 7/02 |
| 2008/0179811 | A1 | 7/2008 | Bernard | |
| 2009/0189333 | A1 | 7/2009 | Coret | |
| 2014/0163723 | A1 | 6/2014 | Geserich | |

* cited by examiner

APPARATUS FOR SEPARATING ITEMS OF MAIL FED TO A FRANKING MACHINE ON A PROCESSING LINE, SUCH AS ENVELOPES, MAILERS, CARDS, PRINTED PRODUCTS, SLEEVES, LABELS

CROSS-REFERENCE TO RELATED APPLICATIONS

The present application claims priority of BP 17 405 030.2, filed Nov. 22, 2017, the priority of this application is hereby claimed and this application is incorporated herein by reference.

BACKGROUND OF THE INVENTION

The invention relates to an apparatus for separating for franking/printing flat items of mail guided in a conveying direction F at one side edge, such as envelopes, mailers, cards, printed products, sleeves, labels or the like, which are supplied individually in a feeder or are guided in an exact position at a front edge lying on one another as a stack and are each gripped at the underside of the stack by a separating device, separated and transported onward in a conveying direction F.

CH 650 995 A5 describes a feed device for a franking machine, which has two sensors arranged one after the other on the conveying track. As the front edge of an envelope passes, the first sensor switches off the drive of a conveying section arranged in a stack space, so that the entrapment of further envelopes is prevented. In addition, as the trailing edge of the envelope passes, it outputs a signal, by means of which a second drive of the second conveying section is slowed, in order then to permit a stoppage.

An apparatus of a franking machine according to EP 1 882 536 A1 has a conveying device formed from conveyor rollers arranged one above another, with which items of mall from a feeder are removed at the underside of a stack. For this purpose, the feeder is formed with a front wall for positioning the stacked items of mail. A conveyor roller positioned immediately after the removal opening is arranged a guide roller interacting with the latter and positioned above it slightly in front. The guide roller is rotatably mounted counter to the loading force acting in the same direction as the conveying direction and holds back excess items of mail arriving at the removal opening.

SUMMARY OF THE INVENTION

It is an object of the present invention to devise an apparatus for separating flat items of mail of the type mentioned at the beginning which is based on a simple processing procedure of physically grounded and mechanically implemented sequences during the separation and onward transport for further processing, so that the result is reliable processing of items of mail of primarily different thickness as far as franking in a franking apparatus connected downstream.

According to the invention, the object is achieved in that the separating device is formed to pick up and transport the respectively lowest item of mail at the front end in the conveying direction, and includes driven conveying drums mounted transversely with respect to the conveying direction and arranged one after another underneath the stack and forming a conveying plane, and forming a passage opening with the lower end of a positioning wall of the feeder and the conveying plane, and a sweeping device acting at least on the lowest item of mail after the passage opening.

To further optimize the separation, the conveying drum connected downstream of the front conveying drum in the conveying direction F is arranged under the sweeping device, interacting with the latter.

Advantageously, for the optimal gripping and conveying of the lowest items of mail in a stack by the conveying drums forming the conveying plane in the upper peripheral region, seen in the conveying direction, are arranged to be approximately uniformly distributed at the passage or outlet opening, so that the result is a gentle withdrawal operation in the conveying plane, the friction between the second lowest item of mail and a feeding device of the separating device being greater than the friction between the lowest and second lowest item of mail.

Preferably, the sweeping device is formed by respectively one sweeping element acting on the lowest item of mail with the front conveying drum, viewed in the conveying direction, and a sensing and restraining element arranged between the same and acting in a manner restraining the supported items of mail, which in this way ensure regular and reliable separation of the respective lowest items of mail and restraining of the items of mall lying above, and act in a gentle manner on the width of an item of mail and contribute to the dimensional stability of the items of mail.

In line with beneficial adaptation of the conveying drums to the partly labile surface of an item of mail, the conveying drums are fixed to a driven shaft supported transversely with respect to the conveying direction F in a machine frame, along which individual rollers are fixed at lateral intervals.

The conveying drums, preferably having the same peripheral speed, have the same diameter for reasons of simplicity, which has a beneficial effect on the conveying plane formed and the requisite drive elements.

As driven conveying drums, these have on the periphery a covering benefitting the friction, for example of a rubber-like material, for a better frictional connection to the items of mail.

For the purpose of connection to a further processing apparatus connected downstream of the separating device, for example a franking unit, a same type of conveying drum is preferably connected downstream of the conveying drums, lengthens the conveying plane in the conveying direction and, as a result, ensures the onward conveyance and frees up the sweeping area.

It proves to be advantageous if the sweeping elements of the sweeping device acting in a sweeping manner on the lowest item of mail on the front conveying drum in the conveying direction F have an elastically flexible sweeping member set relative to the conveying plane at an acute angle counter to the conveying direction, which lines up in a sweeping manner with a lower front edge on the lowest item of mail and to some extent transfers the action of a paintbrush, wherein it can also be a cloth-like sweeping element made of a flexible material, which is fixed to the head of a lever arm by means of a screw-fastenable plate, in the sense of a washer.

The sweeping member is expediently fixed to a pivotable end of a lever arm of a sweeping element arranged transversely relative to the conveying direction F of the items of mail in the machine frame and mounted about a horizontal axis, and rests on a stop formed of a plate slotted in an E shape, in such a way that the front edge of the sweeping member can be lifted as it encounters the lowest item of mail on the front conveying drum.

In the case of the configuration of the sweeping device, it is crucial that a sensing and restraining element is provided between the sweeping elements and restrains the items of mail which follow the respective lowest item of mail out of the superordinate stack and/or frees up the lowest item of mail for separation.

To the benefit of the inherent stability and rigidity, the machine frame can be equipped with a base forming a horizontal surface underneath the conveying plane, which has rectangular cut-outs for the conveying drums projecting partly upward and intended to form the conveying plane, and are provided to optimize the guidance of the items of mail along the conveying plane.

In line with simple adjustment of the sensing and restraining element, a lever arm attached about a shaft arranged transversely with respect to the conveying direction is provided, to the pivotable end of which a positioning element intended to restrain the items of mail following the lowest item of mail is fixed at an acute angle to the conveying plane.

The ability of the lever arms of the sweeping elements and of the sensing and restraining element to pivot is suitable for them to be arranged beside one another at intervals on a common drive shaft traversing the machine frame above the conveying plane, and the lever arm of the sensing and restraining element to be supported on the machine frame such that it can be adjusted and positioned.

Preferably, the lever arms of the sweeping elements are connected adjustably and displaceably to the lever arm of the sensing and restraining element, so that when the sensing and restraining element is repositioned, the sweeping elements are also positioned.

It is possible to adjust the lever arms of the sweeping elements and of the sensing and restraining element separately on the machine frame in each case, in particular when the formats and thicknesses of the items of mail change considerably and/or sensing and restraining element and the sweeping elements have to be re-adapted.

During a common adjustment or displacement of the sensing and restraining and sweeping elements, it is expedient if the sweeping elements are connected or coupled to the sensing and restraining element by a dragging device, so that a uniform change on the sweeping device can occur.

For a common displacement of the lever arms by the dragging device, the lever arm of the positioning and restraining element has laterally projecting drivers resting and engaging under the lever arms of the adjacent sweeping elements so as to effect movement.

For this purpose, the lever arms of the sweeping elements are held on the lever arm of the sensing and restraining element by means of spring force.

The invention will be explained below with reference to the cited or citing prior art and the drawing, to which reference will be made with respect to all details not specifically mentioned in the description, by using an exemplary embodiment.

DETAILED DESCRIPTION OF THE INVENTION

Figure 1:
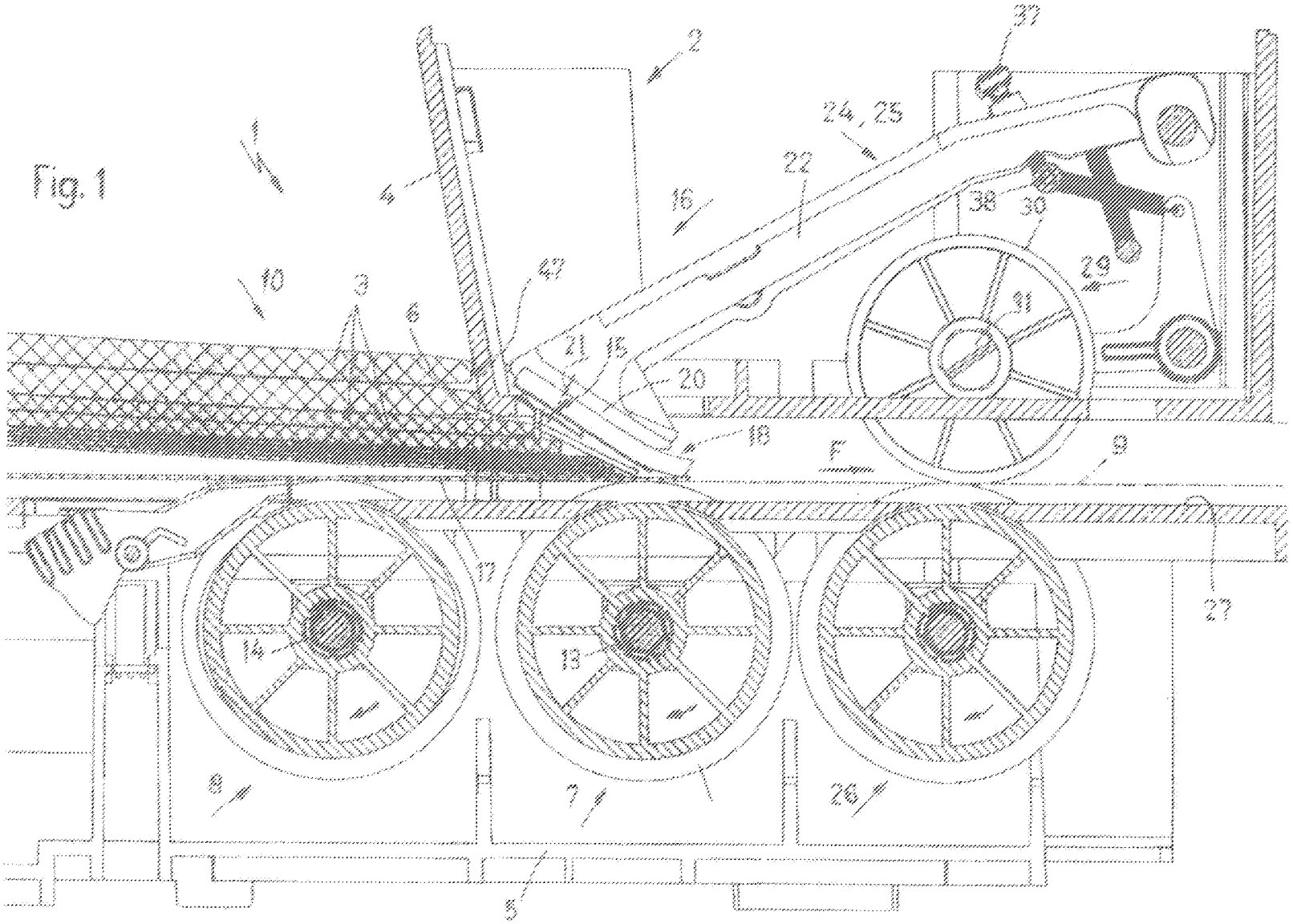
FIG. 1 shows a partial longitudinal section through a separating device, primarily for items of mail.

FIG. 1 shows a separating device for processing flat items of mail 3 arriving in stacked form in a feeder 2, such as envelopes, mailers, cards, printed products, sleeves, labels or the like, which have a different or identical two-dimensional format, different or identical thickness. The feeder 2 has a front positioning wall which is arranged so as to be vertically adjustable in a machine frame 5 of the separating device 1, inclined rearward in the conveying direction F of the items of mail 3 to be separated.

A lower edge 6 of the positioning wall of the feeder 2 is formed so as to be angled in the conveying direction F, so that the items of mail 3 emerging from the feeder 2 can be transported so as to be not damaged on the upper side and without hindrance.

At a distance from the lower edge 6 of the positioning waif 4, two conveyor rollers 7, 8 arranged to be distributed jointly form a horizontal conveying plane 9, on which the respective lowest item of mail 3 from a stack rests and is transported as it leaves the feeder 2 and during the separating operation. The front 7 and the rear conveyor rollers 8 in the conveying direction F preferably have the same diameter and the same peripheral speed and also the same direction of rotation.

Expediently, the conveying width of a conveyor roller 7, 8 is formed from a plurality of individual rollers 11 spaced apart laterally, so that the transported items of mail 3 can rest snugly on the surface.

The running surfaces of the conveyor rollers 7, 8 are equipped with a frictional covering, which exerts a conveying action that is largely uniformly distributed to an item of mail and is slip-free on the individual rollers 11 fixed to shafts 13, 14 mounted in the machine frame 5.

FIG. 1 also indicates with a dash-dotted line the conveying plane 9, on which the lowest item of mall 3 is located indirectly before the removal from the feeder 2. By contrast, the remainder of the stack 10 that has remained in the stack rests with the rear end on a support roller, not visible, so that the lowest item of mail 17 can be loosened from the stack, as can be seen in FIG. 1.

With the conveying plane 9, the lower edge 6 of the positioning wall 4 forms a passage opening 15 for the items of mail 3 to be removed from the feeder 2. The passage opening 15 extends over the conveying width of the conveying drums 7, 8 and is variable in height, i.e. Is adapted to the respective thickest item of mail 3 located in the feeder 2.

According to FIG. 1, there are nine items of mail 3 of different thickness leaving the feeder 2, which have reached the passage opening 15 at the lower end of the feeder 2, wherein the lowest item of mail 17 has already been released from the remainder of the stack and has been gripped at the front end in the conveying direction F by the front conveyor roller 7. Items of mail 3 that have been pushed forward and are resting on the lowest 17, the rear ends of which are resting on the aforementioned support roller, not visible, in a slightly oblique position, support by means of their weight the conveying drive connection of the lowest item of mail 3 on the conveying drums 7 and 8, of which the conveying drum 7 and the lowest item of mail 17 are already in contact with a waiting sweeping device 16. The sweeping device 16, acting in a sweeping manner on the lowest item of mail 17, promotes the gentle contact with the conveying drum 7 by means of an elastically flexible sweeping member 18 at an acute angle counter to the conveying direction F relative to the conveying plane 9, the lower front edge 19 of said sweeping member 18 being lifted at the front end onto the lowest item of mall 17 resting on the conveying drum 7 and exerting a sweeping effect until the respective next item of mail 3 reaches the front edge 19 of the sweeping member 18. The tatter 18 is formed from an elastically flexible material or a brush formed from bristles and, at the front end, is raised on or out in each case against a stop 20, depending on the thickness of the item of mail 3, and is reset into the initial position—as shown—by the inherent elasticity. The stop 20 is formed in such a way that the sweeping element 18 can be fixed replaceably thereto by a screw connection 21.

The sweeping element 18 coming into contact with the conveying drum 7 via the respective lowest item of mail 17 is fixed to the end of a lever arm 22 of the sweeping device 16.

Figure 2:
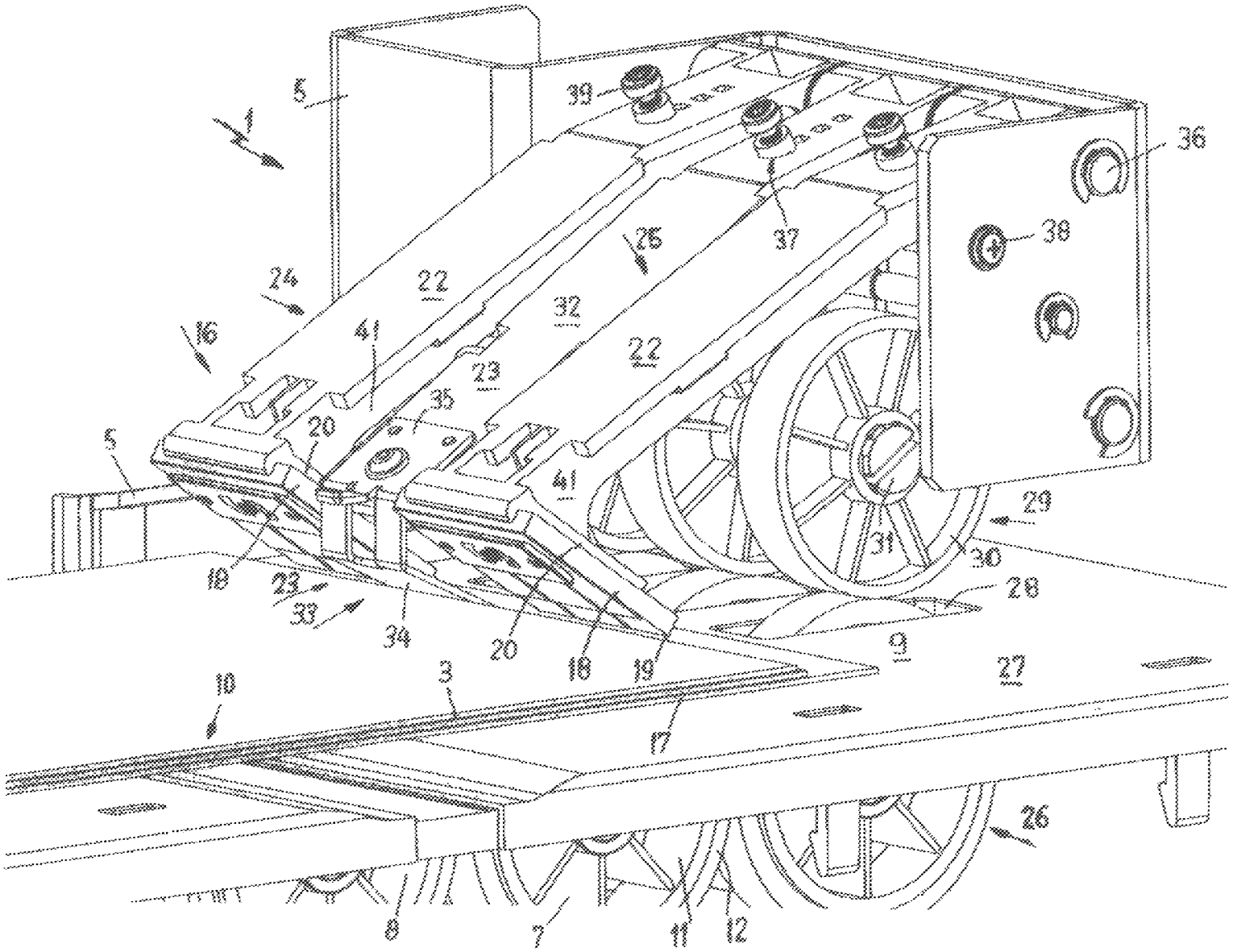
FIG. 2 shows a three-dimensional illustration of the separating device shown in FIG. 1.
Figure 3:
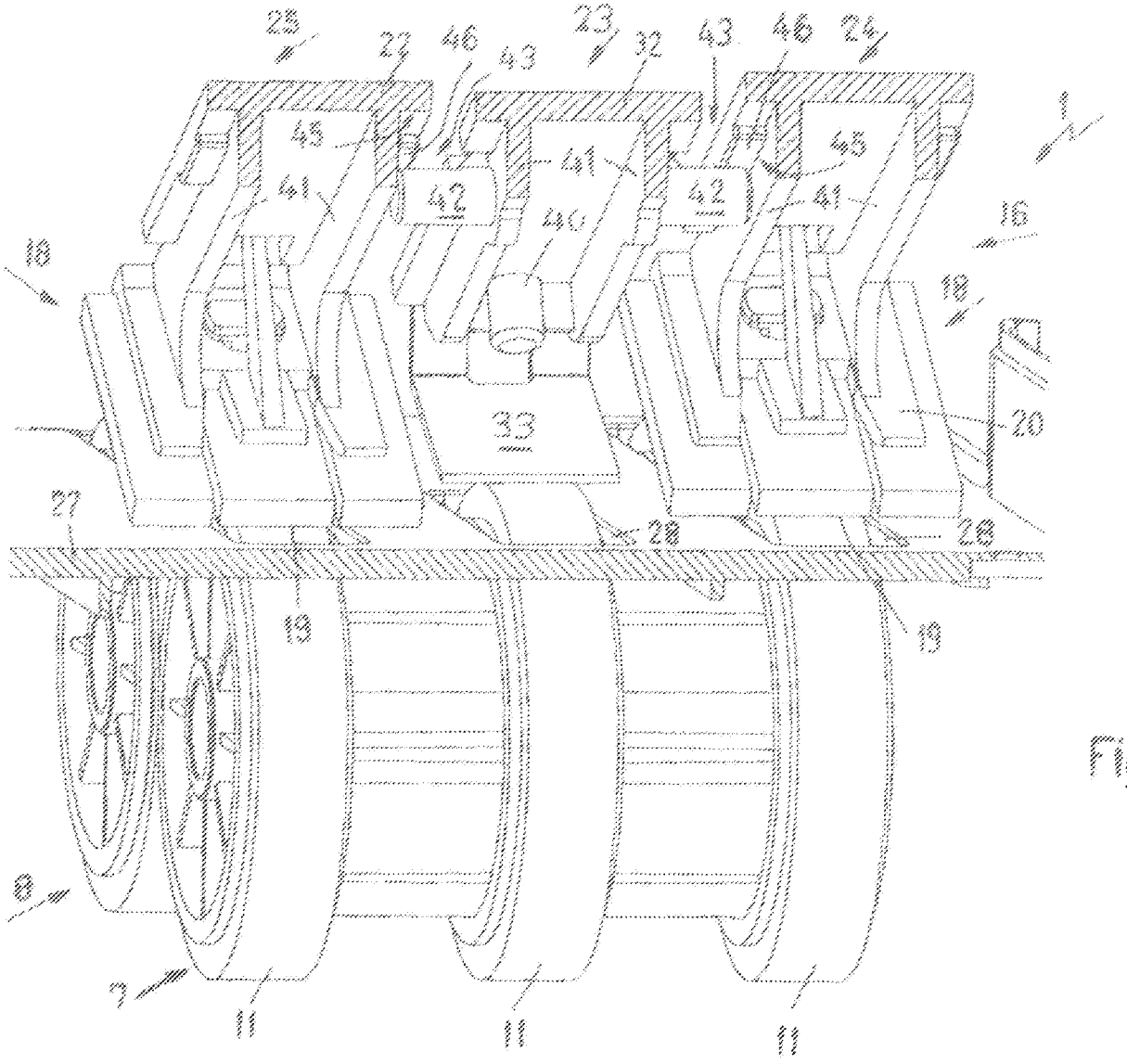
FIG. 3 shows a three-dimensional illustration of the separating device illustrated in FIGS. 1 and 2 from a view directed counter to the conveying direction F.
Figure 4:
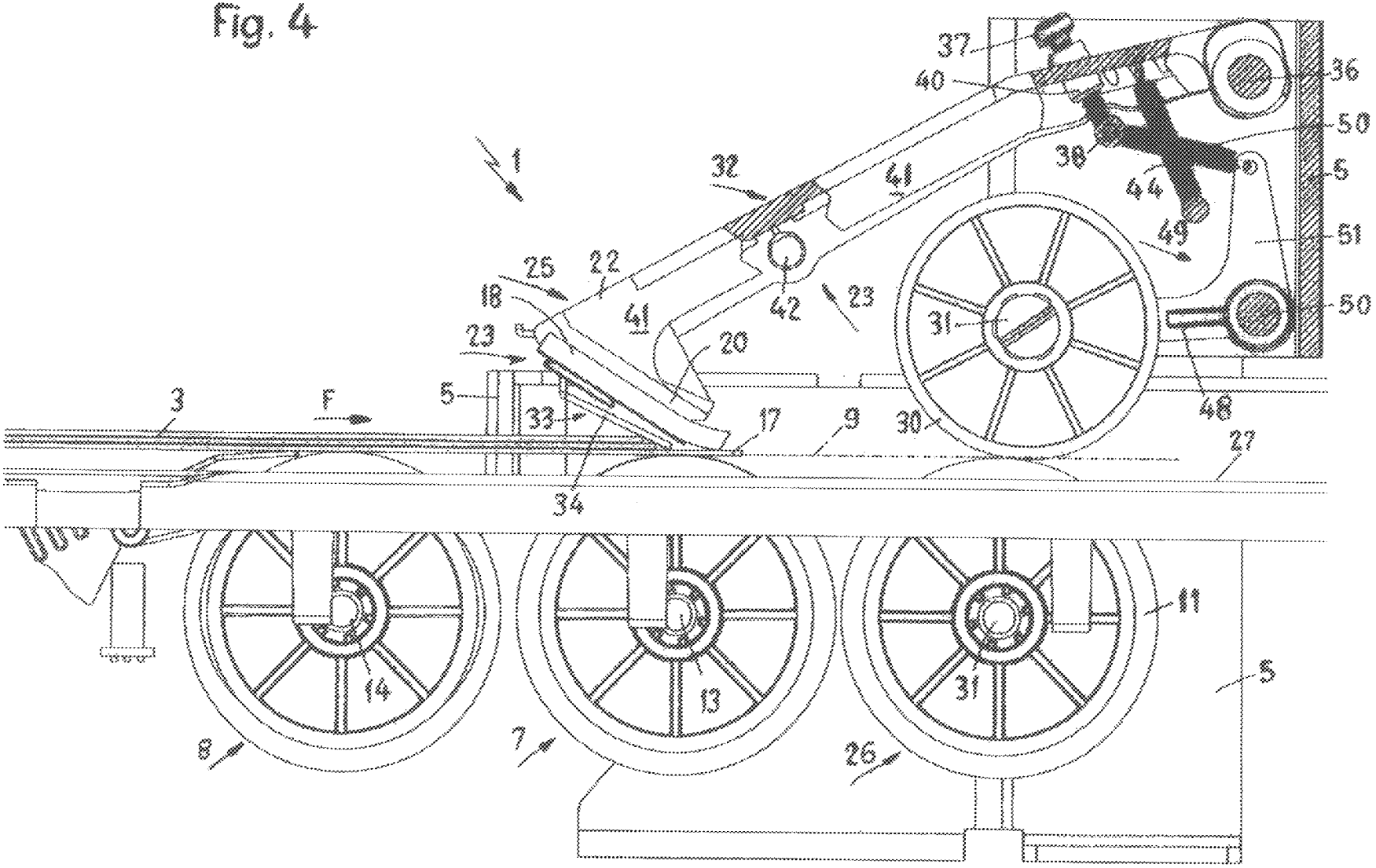
FIG. 4 shows a side view with longitudinally sectioned details of the separating device that can be seen in FIGS. 1 to 3.

FIGS. 2 to 4 refer in detail to the sweeping device 16, which comprises a central sensing and restraining element 23 and sweeping elements 24, 25 arranged on both sides thereof and is otherwise arranged to be distributed over the width of the conveying plane.

FIG. 2 shows the conveying drums 7, 8 which are mounted in the machine frame 5 and which are formed by individual rollers 11 fixed to the shafts 13, 14. A further driven conveying drum 26 with the same peripheral speed and preferably the same diameter is connected downstream of the conveying drums 7, 8 or conveying drum 7 in the conveying direction F of the items of mail 17, 3, being assigned to the conveying plane 9 for the transport of the items of mail 3. The further conveying drum 26 is likewise provided with a friction covering 12 on the periphery. Connected to the machine frame 5 is a base 27 or table forming an approximately horizontal surface, which benefits the stability of the machine frame 5 and ensures protection for the drive elements, in particular of the conveying device, and safe accessibility in conjunction with the separating apparatus 1. The elevated conveying plane 9 is formed by the conveying drums 7, 8, 26, projecting partly upward in cut-outs 28 in the base 27.

For easier understanding, the positioning wall 4 is not illustrated in FIGS. 2 to 4.

The sensing and restraining element 23 between the sweeping elements 24, 25 ensures that items of mail 3 of different thickness are held back over the lowest item of mail 17. In addition, as viewed in the conveying direction F, the sweeping device 16 is arranged to be distributed approximately uniformly over the available conveying width of the conveying drums 7, 8, 26.

Supported on the conveying drum 26 is a freely rotatable guide drum 29, which is mounted in the machine frame 5 and is formed with individual drive rollers 30 fixed to a shaft 31, which rollers interact with the individual rollers 11 of the driven conveying drum 26, forming a conveying gap. The guide drum 29 arranged on the conveying drum 26 is set slightly forward in the conveying direction F as compared with the first.

The guide drum 30 is respectively supported at the free end of a lever arm 48 of an angled two-armed double lever 49 by means of the shaft 31. The double lever 49 is in turn fixed to a shaft 50 arranged transversely with respect to the conveying direction F and is pivotably clamped to the strut 38 by the other lever arm 51 by means of spring 52.

The sensing and restraining element 23 comprises a positioning element. 33 fixed to the pivotable end of a lever arm 32, which has a deflection surface 34 directed counter to the items of mail 3 following after the lowest item of mail 17 and inclined at an acute angle counter to the conveying direction F and is connected to the lever end by means of plate 35. The lever arm 32 of the sensing and restraining element 23 is pivotably mounted on a shaft 36 arranged at a distance above the conveying plane 9 and transversely with respect to the conveying direction F of the items of mail, and is supported on the machine frame 5 by means of setting screw 37. To this end, a strut 38 passing through the machine frame 5 transversely with respect to the conveying direction F is provided, on which a screw 39 that is screwed into the lever arm 32 is displaceably supported. Therefore, the sensing and restraining element 23 on the conveying drum 7 can be adapted and adjusted to the thickness of the incoming lowest items of mail 17 and an optimal separating operation can be achieved.

On the basis of the set value on the sensing and restraining element 23, the lateral sweeping elements 24, 25 are also correspondingly positioned. For this purpose, an eye 40 is fixed to the lever arm 32 of the sensing and restraining element 23 and is penetrated by the setting screw 37, which bears adjustably on the strut 39 (see FIG. 4). The strut 38 is not visible in FIG. 3. The lever arms 22 of the sweeping elements 24, 25 and lever arm 32 of the sensing and restraining element 23 are formed with lateral longitudinal ribs 41 on their underside, to which, in the sensing and restraining element 23, a driver 42 of a dragging device 43, projecting to the side transversely with respect to the conveying direction F of the items of mail 3, is fixed. The lever arms 22 of the sweeping elements 24, 25 bear on the drivers 42 under spring pressure, for which purpose a spring 44 shown in FIG. 4 and fixed to the machine frame 5 is provided.

The drivers 42 directed laterally against the adjacent lever arms 22 of the sweeping elements 24, 25 by the longitudinal ribs 41 of the lever arm 32 of the sensing and restraining element 23 are formed cylindrically, taking into account a low frictional contact, and as a result of spring force rest on the marginal underside 45 of the lever arms 22 of the sweeping elements 24, 25, each formed by a longitudinal rib 41 of the lever arm 22 of a sweeping element 24, 25 and facing the sensing and restraining element 23, on a projecting support 46.

While specific embodiments of the invention have been shown and described in detail to illustrate the inventive principles, it will be understood that the invention may be embodied otherwise without departing from such principles.

I claim:

1. An apparatus for separating flat items of mail guided in a conveying direction at one side edge, which are supplied individually in a feeder or are guided at a front edge lying on one another as a stack, the apparatus comprising:

a separating device that grips the mail item and transports the mail item onward in a conveying direction, wherein the separating device is formed to pick up and transport a respectively lowest item of mail at a front end in the conveying direction, and includes driven conveying drums, mounted transversely with respect to the conveying direction and arranged one after another underneath the stack and forming a conveying plane, and forming a passage opening with a lower end of a positioning wall of the feeder and the conveying plane; and a sweeping device arranged to act at least on the lowest item of mail after the passage opening, wherein the conveying drum connected downstream in the conveying direction is arranged under the sweeping device and interacts with the sweeping device, wherein the sweeping device includes respective sweeping elements arranged to act on the lowest item of mail with the front conveying drum, viewed in the conveying direction, and a sensing and restraining element arranged between the sweeping elements and acting in a manner restraining the items of mail.

2. The apparatus according to claim 1, wherein the sweeping elements of the sweeping device act in a sweeping manner on the lowest item of mail on the conveying drum and have an elastically flexible sweeping member set relative to the conveying plane at an acute angle counter to the conveying direction, which lines up in a sweeping manner with a lower front edge on the lowest item of mail.

3. The apparatus according to claim 2, wherein the sweeping elements each have a pivotable lever arm mounted in a machine frame on a horizontal axis arranged transversely relative to the conveying direction, wherein the sweeping member is fixed to a pivotable end of the lever arm.

4. The apparatus according to claim 3, wherein the sensing and restraining element has a lever arm attached about a shaft arranged transversely with respect to the conveying direction and a positioning element fixed to a pivotable end of the lever arm at an acute angle to the conveying plane, the positioning element being intended for the items of mail following the lowest item of mail.

5. The apparatus according to claim 4, wherein the lever arms of the sweeping elements and of the sensing and restraining element are mounted on a common shaft traversing the machine frame above the conveying plane, and the lever arm of the sensing and restraining element is adjustably and displacably supported on the machine frame.

6. The apparatus according to claim 5, wherein the sweeping elements of the sweeping device are adjustably and displaceably connected to the sensing and restraining element.

7. The apparatus according to claim 5, wherein the lever arms of the sweeping elements and/or of the sensing and restraining element are each adjustable and displaceable individually on the machine frame.

8. The apparatus according to claim 4, further comprising a dragging device that connects to the sensing and restraining element.

9. The apparatus according to claim 8, wherein the lever arm of the sensing and restraining element has laterally projecting drivers engaging under the lever arms of the adjacent sweeping elements so as to effect movement.

10. The apparatus according to claim 9, wherein the lever arms of the sweeping elements are each held against the lever arm of the sensing and restraining element by spring force.

11. The apparatus according to claim 1, wherein the sweeping device is formed by a sensing and restraining device arranged between two sweeping elements.

* * * * *